United States Patent [19]

Hutchins

[11] 4,145,848

[45] Mar. 27, 1979

[54] ROTARY ABRADING TOOL

[75] Inventor: Alma A. Hutchins, Pasadena, Calif.

[73] Assignee: Hutchins Manufacturing Co., Pasadena, Calif.

[21] Appl. No.: 871,818

[22] Filed: Jan. 24, 1978

[51] Int. Cl.[2] ..... B24B 23/00

[52] U.S. Cl. ..... 51/170 T; 51/273

[58] Field of Search ..... 51/170 T, 170 R, 268, 51/273, 270

[56] References Cited

U.S. PATENT DOCUMENTS

| | | | |
|---|---|---|---|
| 1,800,341 | 4/1931 | Davis | 51/170 R |
| 3,827,194 | 8/1974 | Hutchins | 51/170 MT |
| 3,840,976 | 10/1974 | Hutchins | 29/445 |
| 3,854,206 | 12/1974 | Hutchins | 30/368 |
| 4,058,936 | 11/1977 | Marton | 51/170 T |

*Primary Examiner*—Harold D. Whitehead
*Assistant Examiner*—Roscoe V. Parker
*Attorney, Agent, or Firm*—William P. Green

[57] ABSTRACT

A portable abrading tool with a rotary backing unit for carrying a disc of abrading material, with abraded particles being drawn through a passage or passages in the backing unit into a shroud carried at a rear side of that unit, and with the backing unit carrying a circular rib at its rear side projecting rearwardly within a peripheral edge portion of the shroud in axially overlapping relation to define a shoulder blocking centrifugally induced radially outward movement of abraded particles toward the edge portion of the shroud.

13 Claims, 5 Drawing Figures

2
10
11
12
13
16
19
20
21
22
23
24
25
26
27
28
37
38
48
50
51
52
53
54
112

26
29
30
31
32
33
34
35
36
37
38
39
40
44
47
49
55
57
58

3
4
5
10
11
12
19
22
35
37
40
44
45
47
48
49
53
55
~18~
135

26
28
29
30
31
32
33
34
35
36
37
55
57
58
~135~

14
15
16
17
18
28
29
30
31
32
37
38
42
43
51
53
56

ROTARY ABRADING TOOL

BACKGROUND OF THE INVENTION

This invention relates to improved portable abrading tools in which particles abraded from a work surface are withdrawn by suction through the tool to a collection location.

The tools of the present invention are of a known general type in which a portable body adapted to be held by a user contains a motor acting to drive a work contacting abrading structure rotatively about an axis. The abrading structure includes a rotary backing unit adapted to carry a sheet of sandpaper or other abrading material at the forward side of that unit and containing one or more passages through which a flow of air and entrained abraded particles are drawn by suction to the rear side of the backing unit. A shroud is provided at the rear side of the backing unit to define a chamber through which the air and entrained particles flow in confined relation to an outlet leading to the accumulation point.

In prior devices of this type having such rotary backing units and non-rotating shrouds co-acting therewith, there has been a tendency for the rapid rotary motion of the backing unit to cause abraded particles contacting that unit to move radially outwardly at the rear side of the backing unit under the influence of centrifugal force, with some resultant tendency for these centrifugally urged particles to then escape past the periphery of the backing unit and between it and the stationary shroud to the exterior of the shroud. The rate of flow of suction air through the device may under some circumstances be insufficient to overcome this centrifugal effect and prevent unwanted escape of the abraded particles into the atmosphere.

SUMMARY OF THE INVENTION

The general purpose of the present invention is to provide an improved inter-relationship between the backing unit and shroud in a rotary suction type abrading tool of the above discussed general character, with the new relationship being especially designed to prevent the mentioned tendency for escape of some dust particles past the periphery of the rotating backing unit. A device constructed in accordance with the invention acts to intercept and block radially outward movement of the dust particles at the rear side of the backing unit before the particles can reach the forward edge portion of the shroud. At the same time, however, this result is obtained with a minimum of added structure, and in a manner avoiding any possible interference with proper functioning of the device.

Structurally, this improved confinement of the abraded dust particles is accomplished by forming on the rear side of the rotary backing unit or disc an essentially annular rib which extends circularly about the rotary axis of the device and projects rearwardly beyond a portion of the backing unit located radially inwardly of that rib. The rib is received within a forward edge portion of the shroud, in axially overlapping relation, so that the rib can intercept dust particles moving radially outwardly under centrifugal force before those particles have an opportunity to reach the edge of the shroud. The rib is desirably located closely adjacent the edge of the shroud, and the resultant circuitous path which dust particles must follow to escape from the shroud and past the periphery of the backing unit is sufficiently indirect to effectively preclude escape of the particles at that location, and enables the suction air to maintain control of the particles and withdraw them from the shroud to the accumulation point. For best results, both the rib and the surrrounding edge portion of the shroud extend substantially directly axially, and are of straight cylindrical configuration. Any possibility of escape of particles between these parts may be further minimized by providing a seal element between these parts, desirably carried by the shroud and annularly engaging a circular rear edge of the rib in sealing relation.

BRIEF DESCRIPTION OF THE DRAWING

The above and other features and objects of the invention will be better understood from the following detailed description of the typical embodiment illustrated in the accompanying drawing, in which.

DESCRIPTION OF THE PREFERRED EMBODIMENT

Figure 1:
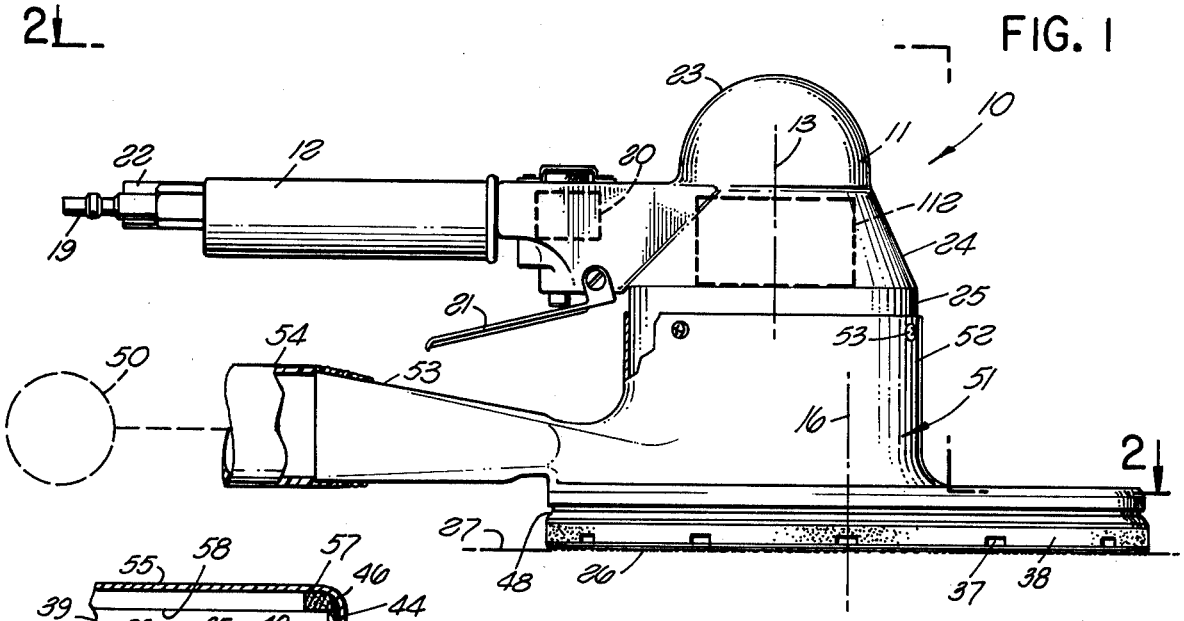
FIG. 1 is a side view of a sanding or grinding tool constructed in accordance with the invention.
Figure 2:
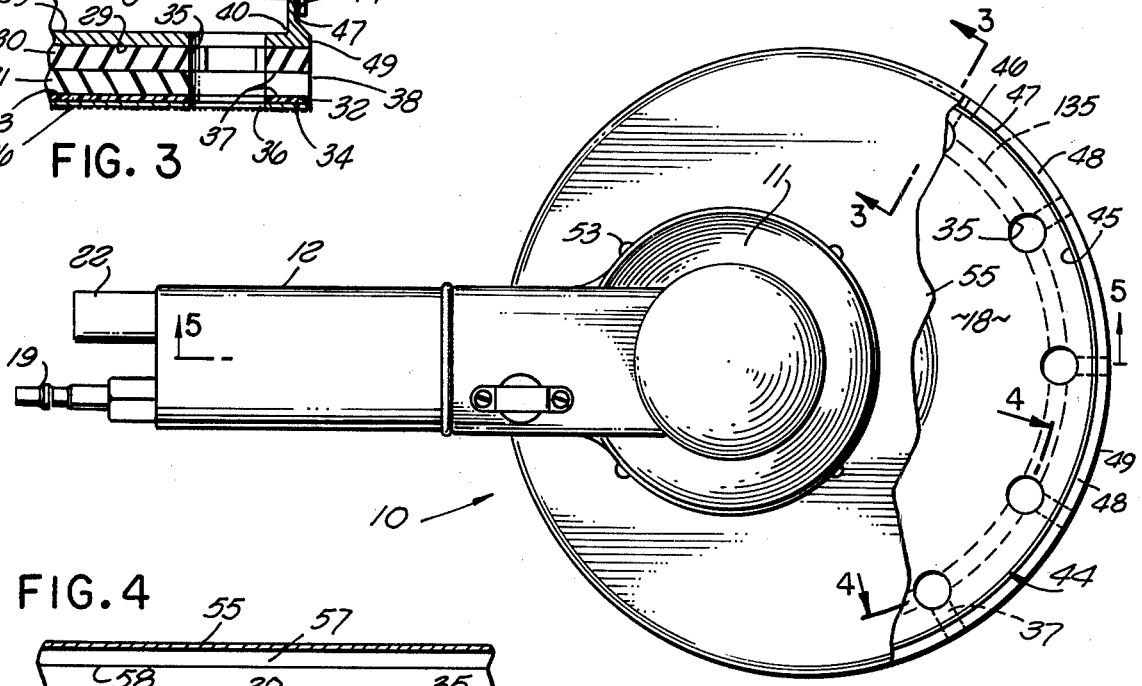
FIG. 2 is a plan view of the FIG. 1 tool, partially broken away, and taken on line 2—2 of FIG. 1.
Figure 5:
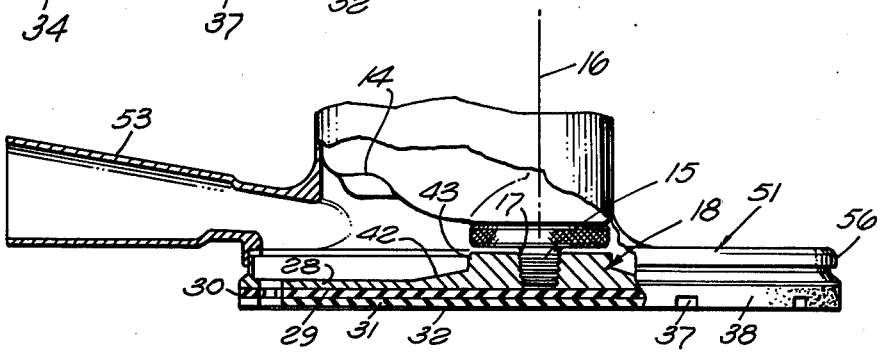
FIG. 5 is a fragmentary vertical section taken primarily on line 5—5 of FIG. 2.

Referring first to FIGS. 1 and 2, the sanding or abrading tool 10 shown in those figures includes a portable body 11 having a handle portion 12 by which the tool may be manipulated. The body 11 contains a compressed air driven motor represented diagrammatically at 12 in FIG. 1, with that motor typically being of the vane type and having its rotor mounted to turn about a vertical axis 13. This rotor acts through a speed reduction gear contained within a lower portion 14 of the housing (FIG. 5) to drive an output shaft 15 (FIG. 5) turning about an axis 16 which is parallel to but eccentric with respect to the motor axis 13. The output shaft 15 of the motor may be externally threaded as shown, to connect detachably into a threaded central bore 17 formed in a backing unit 18 of the device. Compressed air for driving motor 12 may be fed to the motor from an inlet line 19 through a passage contained within handle 12 of the tool, and under the control of a valve 20 actuated by a trigger element 21. Discharged air from motor 12 may exhaust through an outlet 22, which may if desired be connected to a flexible hose leading the exhaust air to a location remote from the tool.

The body 11 of the tool may have an upper, externally rounded, spherically curved surface 23 against which a person may exert downward force in using the tool. This upper convexly rounded portion 23 of the tool body may be centered about axis 13, as may a downwardly flaring outer surface 24 of the body leading to an external vertical cylindrical surface 25 also centered about axis 13.

The backing unit 18 carries a sandpaper disc 26 which is disposed transversely of axes 13 and 16, and which is engageable with a work surface represented at 27 to abrade that surface. Unit 18 includes a rigid backing disc 28, typically formed of an appropriate metal such as aluminum, and having a forward planar surface 29 disposed directly transversely of axis 16 and carrying appropriate cushioning material. This cushioning material may include two resiliently deformable cushioning layers 30 and 31, appropriately bonded together by adhesive or the like, and bonded to surface 29 of the metal part 28. Layers 30 and 31 may be formed of foam rubber or other appropriately elastomeric cushioning material, and may carry at their forward side an outer layer of flexible material 32, typically formed of appropriate flexible plastic film or other material, and preferably reinforced by a layer of fabric 33. These layers 32 and 33 are of course adhered to one another and to the layer 31, with the front face 34 of forward layer 32 being planar and disposed transversely of axis 16. The elements 28, 30, 31, 32 and 33 are all peripherally circular about axis 16, as is the sandpaper disc 26. The latter may be secured to the front planar surface 34 of the cushioned backing unit in any appropriate manner, as by use of a suitable adhesive, either carried by the sandpaper sheet 26, or applied by brush or otherwise to the contacting surfaces before the sandpaper sheet is attached to the backing unit.

All of the layers 28, 30, 31, 32 and 33 of the backing unit contain registering preferably circular passages 35 (FIGS. 2, 3 and 4) extending through the entire thickness of the backing unit to conduct abraded particles from its forward face to the back of that unit. Similarly, circular apertures 36 are formed in the sandpaper sheet 26 at correspondingly circularly spaced locations, to pass the abraded particles through the sandpaper sheet and into passages 35. The passages 26 may be in communication with one another through a circular passage 135 formed in cushioning layer 31. Leading into each of the various passages 35 in these parts, the cushioning material may contain another passage 37, extending radially inwardly from the peripheral edge 38 of part 31 into the corresponding passage 35, to allow particles to flow inwardly from about the backing unit 18 into the passages 35 and then upwardly through those passages to the upper or back side of part 28.

The upper or back surface 39 of part 28 is desirably planar and disposed directly transversely of axis 16 from the outer circular edge 40 of that surface to a location 41 (FIG. 5) at which the metal part 28 may increase slightly in thickness at 42, to the location of a further thickened central externally circular portion 43 of part 28 within which the previously mentioned internally threaded bore 17 is provided.

At the outer edge of back surface 39 of part 28, this part carries and forms a rib or rim 44 (FIG. 3), centered about axis 16, and containing an inner straight cylindrical surface 45 centered about axis 16 and extending to a circular rear edge 46 of the rib. Externally, the rib 44 has an outer straight cylindrical surface 47 centered about axis 16, and merging with a flaring surface 48 also centered about that axis. This surface 48 terminates at a circular edge surface 49 aligned axially with the outer edge surfaces of parts 30, 31, 32 and 33.

Figure 3:
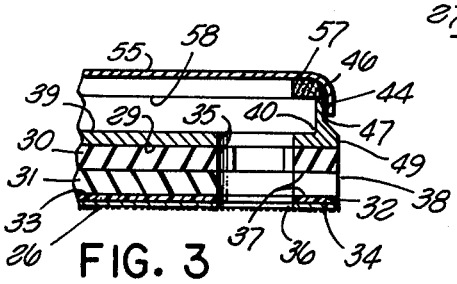
FIG. 3 is an enlarged vertical fragmentary section taken on line 3—3 of FIG. 2.
Figure 4:
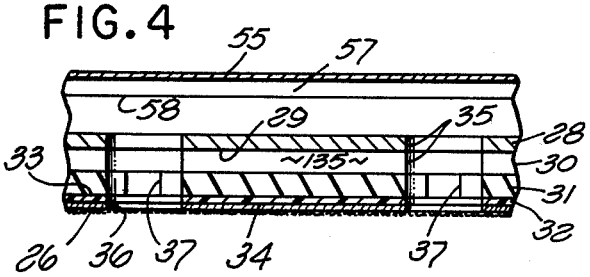
FIG. 4 is a fragmentary enlarged vertical section taken on line 4—4 of FIG. 2.

The flow of air and entrained dust particles upwardly through passages 35 of FIG. 3 is induced by a suction or vacuum cleaner device represented diagrammatically at 50 in FIG. 1. This flow of air and particles is confined by a shroud 51 carried by body 11 of the tool. Shroud 51 may be molded or cast to the configuration illustrated in the figures, and may typically be formed of either an appropriate essentially rigid resinous plastic material or a suitable metal or the like. The shroud is shaped to have an upper tubular straight cylindrical mounting portion 52 centered about axis 13 and of an internal diameter to fit closely about surface 26 of body 11. This portion 52 is secured on the cylindrical portion of the body in appropriate manner, as by a number of circularly spaced screws 53. At its left side as viewed in FIG. 1, shroud 51 has an outlet tube 53 communicating with the interior of the shroud to conduct air and particles from within the shroud into a flexible hose element 54 connected to the outlet 53 and leading to suction unit 50 at which the particles are collected. At the lower end of its mounting portion 52, the shroud is shaped to form a flange or wall 55, which may be planar and extends directly transversely of axes 13 and 16 at a location spaced axially above or rearwardly of back surface 39 of part 28. At its periphery, this transverse wall 55 of the shroud carries an axially turned peripheral edge portion 56 of the flange, which is of straight cylindrical configuration about axis 11 except insofar as the juncture of walls 55 and 56 is curved or rounded as seen in FIG. 3. At the juncture of these walls, the shroud carries a deformable seal element 57, desirably formed as a ring of felt or other similar material, which may be secured by an appropriate adhesive to the shroud, in fixed relation thereto, and which has a transverse typically planar forward or lower face 58 annularly engaging rear edge surface 46 of the rib 44. The contact between these parts is close enough to form a seal preventing movement of dust particles therebetween. Also, the axially extending edge portion 55 of the shroud, which axially overlaps rib 44, is received in closely spaced relation to the rib as shown.

In using the tool, a person first places in operation the vacuum unit 50 to commence flow of air through the vacuum unit 18 and into the interior of shroud 51, and then through outlet 53 to unit 50. The user then grasps the tool by handle 12 and places it on a work surface such as that shown at 27, and may then press downwardly on the tool with his other hand at 23. By actuating the trigger element 21, he admits air to motor 12, to act through the reduction gear to drive output shaft 15 of the motor unit and the connected backing unit 18 and carried sandpaper sheet 26. As the unit 28 and the sandpaper sheet turn, they abrade particles from work surface 27, and the suction created by unit 50 acts to draw those particles upwardly through openings 16 in the sandpaper and passages 35 into the interior of the shroud. Particles which escape to a location about the sandpaper sheet are drawn through the branch passages 37 into passages 35 to also flow into the shroud. The suction unit 50 withdraws the particles from the shroud for collection at unit 50.

As the backing unit 28 rotates rapidly, dust particles which contact any portion of the spinning unit 18, including its rear surface 39, tend to be thrown radially outwardly away from axis 11 by centrifugal force. If these particles reach the location of rib 44, they strike that rib and are blocked by it against further radially outward movement. The seal between the rear edge of that rib and seal element 57 further minimizes the possibility of escape of any of these particles, as does the circuitous path which such particles must follow in order to flow axially between the closely proximate edge portion 56 of the shroud and the outer surface of the axially overlapping rib 44 on the backing unit. These various effects together function to maintain control over the particles and prevent their escape long enough to permit the moving stream of suction air to pick up the particles and carry them from the shroud through outlet 53 and to unit 50.

While a certain specific embodiment of the present invention has been disclosed as typical, the invention is of course not limited to this particular form, but rather is applicable broadly to all such variations as fall within the scope of the appended claims.

I claim:

1. A portable abrading tool comprising:

a portable body;

a motor carried by said body;

a backing unit driven rotatively relative to said body by said motor about a predetermined axis and adapted to carry a sheet of abrading material at a forward side of the unit and having a front surface facing in a forward axial direction for applying backing force to said abrading material;

said backing unit containing at least one passage through which a flow of air and entrained abraded particles passes to the rear side of said unit; and a shroud carried by said body at said rear side of the backing unit and having an edge portion extending essentially circularly about said axis and extending generally axially into close proximity to said backing unit, with the shroud defining a chamber through which said air and entrained particles flow in confined relation;

there being an outlet through which said air and entrained particles flow from said chamber in the shroud;

said backing unit carrying an essentially circular rib which is centered about said axis and projects rearwardly beyond an adjacent rear surface of the backing unit radially inwardly of the rib;

said rib being received within said edge portion of the shroud in axially overlapping relation to block centrifugally induced radially outward movement of said particles toward said edge portion of the shroud.

2. A portable abrading tool as recited in claim 1, including a sealing element carried by said shroud and annularly engaging said rib in sealing relation.

3. A portable abrading tool as recited in claim 1, in which said rear surface of the backing unit is essentially planar and disposed substantially directly transversely of said axis.

4. A portable abrading tool as recited in claim 1, in which said backing unit contains a series of said passages at circularly spaced locations and extending through said rear surface near but radially inwardly of said rib.

5. A portable abrading tool as recited in claim 1, in which said rib has a radially inner surface of straight cylindrical configuration centered about said axis.

6. A portable abrading tool as recited in claim 1, in which said shroud has a wall extending substantially directly transversely of said axis at a location spaced rearwardly of said backing unit, said edge portion of the shroud extending axially from the periphery of said transverse wall and into overlapping relation with said rib.

7. A portable abrading tool as recited in claim 1, in which said shroud has a wall extending substantially directly transversely of said axis at a location spaced rearwardly of said backing unit, said edge portion of the shroud extending axially from the periphery of said transverse wall and into overlapping relation with said rib, there being an annular seal element centered about said axis and carried by said shroud at the juncture of said transverse wall and said axially extending edge portion of the shroud and engageable axially against said rib in sealing relation.

8. A portable abrading tool as recited in claim 1, in which said backing unit contains a plurality of said passages at circularly spaced locations extending radially inwardly from the periphery of said backing unit and then extending axially rearwardly to the rear side of the backing unit and into said chamber.

9. A portable abrading tool as recited in claim 1, in which said backing unit includes a series of said passages extending axially through the backing unit near but radially inwardly of said rib, there being branches of said passages extending radially inwardly from the periphery of said backing unit into said passages.

10. A portable abrading tool as recited in claim 1, in which said backing unit has a peripheral portion projecting radially outwardly beyond said rib and to a location axially opposite said edge portion of the shroud.

11. A portable abrading tool as recited in claim 1, in which said body has a portion containing said motor and which is externally essentially circular but located eccentrically with respect to said axis, said shroud including a mounting portion extending about said body and positioned eccentrically with respect to said axis, and a portion extending from said mounting portion to said edge portion of the shroud which is centered about the axis.

12. A portable abrading tool as recited in claim 1, in which said body has a portion containing said motor and having an outer circular surface which is eccentric with respect to said axis, said shroud having a tubular mounting portion centered about said surface of the body and secured thereto and extending essentially axially but located eccentrically with respect to said axis, said shroud having a wall disposed transversely of said axis and extending from said tubular portion to said edge portion of the shroud which is centered about the axis.

13. A portable abrading tool as recited in claim 12, in which said edge portion of the shroud extends directly axially from said transverse portion thereof, there being an annular seal element carried by the shroud at the juncture of said transverse portion and said edge portion and engaged axially against said rib in sealing relation.

* * * * *